US006541914B1

(12) United States Patent
Ahn

(10) Patent No.: US 6,541,914 B1
(45) Date of Patent: Apr. 1, 2003

(54) PLASMA DISPLAY PANEL INCLUDING GROOVES IN PHOSPHOR

(75) Inventor: Young Joon Ahn, Kyongsangbuk-do (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/442,004

(22) Filed: Nov. 17, 1999

(30) Foreign Application Priority Data

Nov. 18, 1998 (KR) ..... 98-49446

(51) Int. Cl.[7] ..... H01J 17/49; H01J 1/62

(52) U.S. Cl. ..... 313/586; 313/582; 313/584; 315/169.4

(58) Field of Search ..... 313/586, 582, 313/583, 584, 585, 587, 581; 315/169.4, 169.3, 169.1

(56) References Cited

U.S. PATENT DOCUMENTS 4,626,071 A * 12/1986 Wada et al. ..... 350/311
5,661,500 A * 8/1997 Shinoda et al. ..... 313/485
5,852,347 A * 12/1998 Marcotte ..... 315/169.4
6,012,388 A * 1/2000 Shirakawa et al. ..... 101/127.1
6,072,276 A * 6/2000 Okajima et al. ..... 313/581
6,124,676 A * 9/2000 Salavin et al. ..... 313/238

FOREIGN PATENT DOCUMENTS

JP 9312129 12/1997
JP 10012150 1/1998
JP 10321145 12/1998

OTHER PUBLICATIONS

Takano et al "A 25–in. High–Contrast Color DC–PDP", 1992 SID DIGEST, pp. 3–6 (no month).*

* cited by examiner

*Primary Examiner*—Nimeshkumar D. Patel
*Assistant Examiner*—Karabi Guharay
(74) *Attorney, Agent, or Firm*—Fleshner & Kim, LLP

(57) ABSTRACT

A PDP minimizes a capacitance of phosphors by removing some of the phosphors of each discharge cell to maintain almost same discharge voltage level applied to discharge areas of each discharge cell. The PDP includes a plurality of lower electrodes successively formed on a first substrate in row direction, a plurality of isolation walls formed between the lower electrodes, a plurality of upper electrode sets successively formed on a second substrate opposite to the first substrate to cross the lower electrodes, and a phosphor formed on the first substrate to expose some of the lower electrodes crossed the upper electrode sets.

26 Claims, 8 Drawing Sheets

PLASMA DISPLAY PANEL INCLUDING GROOVES IN PHOSPHOR

BACKGROUND OF THE INVENTION

1. Field of the Invention

The present invention relates to a plasma display panel (PDP), and more particularly, to a discharge electrode and a phosphor for a PDP, which displays a color image.

2. Background of the Related Art

Generally, a PDP and a liquid crystal display (LCD) have lately attracted considerable attention as the most practical next display of panel displays. In particular, the PDP has higher luminance and wider visible angle than the LCD. For this reason, the PDP is widely used as a thin type large display such as an outdoor advertising tower, a wall TV, and a theater display.

The PDP performs display operation in such a manner to emit a phosphor using ultraviolet rays generated by gas discharge. Such a PDP includes an AC PDP having a dielectric layer on an electrode surface and a DC PDP in which an electrode surface is exposed to a discharge space. In the AC PDP, the phosphor is formed on the dielectric layer. In the DC PDP, the phosphor is formed on the electrode.

FIG. 1 shows a structure of a related art AC PDP of three-electrode area discharge type. As shown in FIG. 1, the related art AC PDP of three-electrode area discharge type includes an upper structure, a lower structure, and a discharge area 5. The upper structure includes an upper electrode 4 having a Y electrode and a Z electrode on the same plane of a front glass substrate 1, a dielectric layer 2 formed on the upper electrode 4 by printing, and a passivation layer formed on the dielectric layer 2. The lower structure includes an X electrode 12 formed on a rear glass substrate 11 of the upper structure to cross the upper electrode 4, an isolation wall 6 formed between the X electrode and the X electrode to prevent crosstalk between adjacent cells, and phosphors 8, 9 and 10 formed around the isolation wall 6 and the X electrode 12. The discharge area 5 is formed by sealing an inert gas in a space between the upper structure and the lower structure. For reference, in FIG. 1, the upper substrate is rotated by 90°.

The AC PDP of three-electrode area discharge type generates opposite discharge between the X electrode and the Y electrode if a driving voltage is applied between the X electrode and the Y electrode. As a result, wall charge occurs on a surface of the passivation layer of the upper structure. If discharge voltages having opposite polarities are continuously applied to the Y electrode and the Z electrode while the driving voltage applied to the X electrode is broken, area discharge occurs in the discharge area on surfaces of the passivation layer 3 and the dielectric layer 2 due to potential difference which is generated between the Y electrode and the Z electrode by wall charge. This area discharge generates ultraviolet rays 7 from the inert gas of the discharge area. The ultraviolet rays 7 excite the phosphors 8, 9, and 10. The excited phosphors 8, 9 and 10 are emitted to display color.

In other words, electrons in the discharge cell are accelerated to negative electrode by the driving voltage. The accelerated electrons come into collision with the inert mixing gas filled in the discharge cell at a pressure of 400~600 torr. The inert mixing gas is a penning mixing gas containing He as a main component and further containing Xe and Ne. The inert gas is excited by the collision to generate ultraviolet rays having a wavelength of 147 nm. The ultraviolet rays come into collision with the phosphors 8, 9 and 10 surrounding the lower electrode 12 and the isolation wall 6, so that light of a visible right ray region is emitted.

The PDP discharges a cell having pixels by controlling the voltages applied to the X, Y and Z electrodes. The intensity of light emitted by this discharge varies discharge time of the cell. In other words, gray scale required to display and image displays the image within the time required to display the entire image, for example, 1/30 seconds in case of NTSC TV signal, by varying the time length of discharge for each cell. At this time, the luminance of the screen is determined by brightness when each cell is discharged to the utmost. To obtain the highest luminance in the PDP screen, it is necessary to maintain the discharge time of the cell to the utmost within the time required to display one screen.

FIG. 2 is a block diagram showing a structure of a PDP having a driving circuit, in which a panel, an X electrode drive 10, a Y electrode driver 20 and a Z electrode driver 30 are shown.

The X electrode 12 formed in each cell of the PDP in FIG. 1 is connected to the X electrode driver 10 so that an address voltage is applied to the X electrode 12. The Y electrode 25 is connected to the Y electrode driver 20 so that a scan voltage is applied to the Y electrode 25. The Z electrode 35 is connected to the Z electrode driver 30 so that a sustain voltage is applied to the Z electrode 35.

The X, Y and Z electrodes constitute a matrix arrangement. The matrix arrangement acts as a display area 50 of the PDP. The Y electrode 25 and the Z electrode 35 in FIG. 2 correspond to the upper electrode 4 in FIG. 1.

FIG. 3 shows waveforms of pulses applied to the respective electrodes of the PDP, in which the respective pulses show different waveforms in a reset period, an address period and a sustain period.

A reset pulse 21 of the scan voltage output from the Y electrode driver 20 is simultaneously applied to all of Y electrodes 25 in each discharge cell of the PDP. The Y electrode driver 20 inserts a scan pulse 22 into a sustain pulse 80 of the scan voltage applied to the Y electrode 25 so as to generate opposite discharge against the X electrode 20 referring to scan data. At this time, an address pulse 60 output from the X electrode driver 10 is applied to the X electrode 12. The sustain voltage applied to the Z electrode 35 has a phase opposite to the sustain pulse 80 of the scan voltage and has the same period as the sustain pulse. The address pulse 60 applied to the X electrode 12 is synchronized with the scan pulse 22 applied to the Y electrode 25 and has a phase opposite to the scan pulse. Accordingly, the X electrode 12 and the Y electrode 25 generate opposite discharge by voltage difference between the address pulse 60 and the scan pulse 22. The Y electrode 25 and the Z electrode 35 generate area discharge by voltage difference between the sustain pulse of the scan voltage and the sustain voltage. Then, if the address pulse 60 is applied to the scan voltage, area discharge stops, thereby turning off the discharge cell.

In case of opposite discharge, a red phosphor, a blue phosphor and a green phosphor formed in each discharge cell are emitted by different voltage levels, respectively. In other words, a discharge voltage in which ultraviolet rays for emitting the red phosphor are generated, a discharge voltage in which ultraviolet rays for emitting the blue phosphor are generated, and a discharge voltage in which ultraviolet rays for emitting the green phosphor are generated differ from one another because dielectric constants of the respective phosphors differ from one another. Therefore, the opposite discharge time and luminance are varied depending on the respective phosphors formed in the discharge cells of the PDP even if the same discharge voltage is applied to the respective discharge cells.

FIG. 4 shows an equivalent circuit of discharge cells of the PDP to which the discharge voltage is applied.

It is assumed that the phosphors are deposited on the electrode of the upper substrate in the same manner as the related art three-electrode area discharge type.

In FIG. 4, a voltage Vs is an externally applied voltage to the discharge cell, $C_1$ is a capacitance of the upper substrate in the cell to be discharged, Cg is a capacitance of the discharge space, Cp is a capacitance of the phosphor to be emitted, and $C_2$ is a capacitance of the lower substrate in the cell to be discharged excluding Cp.

The voltage applied to the discharge space of the respective discharge cells is susceptible to the capacitance of the phosphors formed in the respective discharge cells. The capacitance of the phosphors is determined by the thickness of the phosphors and their dielectric constants. Generally, the dielectric constant of the green phosphor is greater than the dielectric constants of the red and blue phosphors. Therefore, the voltage applied to the discharge area of the discharge cell of the green phosphor is smaller than the voltages applied to the discharge areas of the discharge cells of the red and blue phosphors.

The aforementioned related art PDP has several problems.

Since the voltage applied to the discharge space of the respective cells is susceptible to the capacitance of the phosphors formed in the respective discharge cells, the discharge voltage actually applied to the discharge area is varied depending on the respective discharge cells, thereby generating differences in emitting luminance and emitting time.

In other words, the capacitance of the capacitor of the phosphors is determined by the thickness and dielectric constants of the respective phosphors. Since the dielectric constant of the green phosphor is greater than the dielectric constants of the green and blue phosphors, the voltage applied to the discharge area of the discharge cell of the green phosphor is smaller than the voltages applied to the discharge areas of the discharge cells of the green and blue phosphors. Accordingly, if the same voltage is applied to the respective discharge cells, the discharge cell of the green phosphor is emitted for the last time, thereby deteriorating picture quality of the PDP.

SUMMARY OF THE INVENTION

Accordingly, the present invention is directed to a PDP that substantially obviates one or more of the problems due to limitations and disadvantages of the related art.

An object of the present invention is to provide a PDP in which the same discharge voltage is maintained in all of discharge cells.

Other object of the present invention is to provide a PDP which minimizes a capacitance of phosphors by removing some of the phosphors of each discharge cell to maintain almost same discharge voltage level applied to discharge areas of each discharge cell.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a PDP according to the present invention includes a plurality of lower electrodes successively formed on a first substrate in row direction, a plurality of isolation walls formed between the lower electrodes, a plurality of upper electrode sets successively formed on a second substrate opposite to the first substrate to cross the lower electrodes, and a phosphor formed on the first substrate to expose some of the lower electrodes crossed the upper electrode sets.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1:
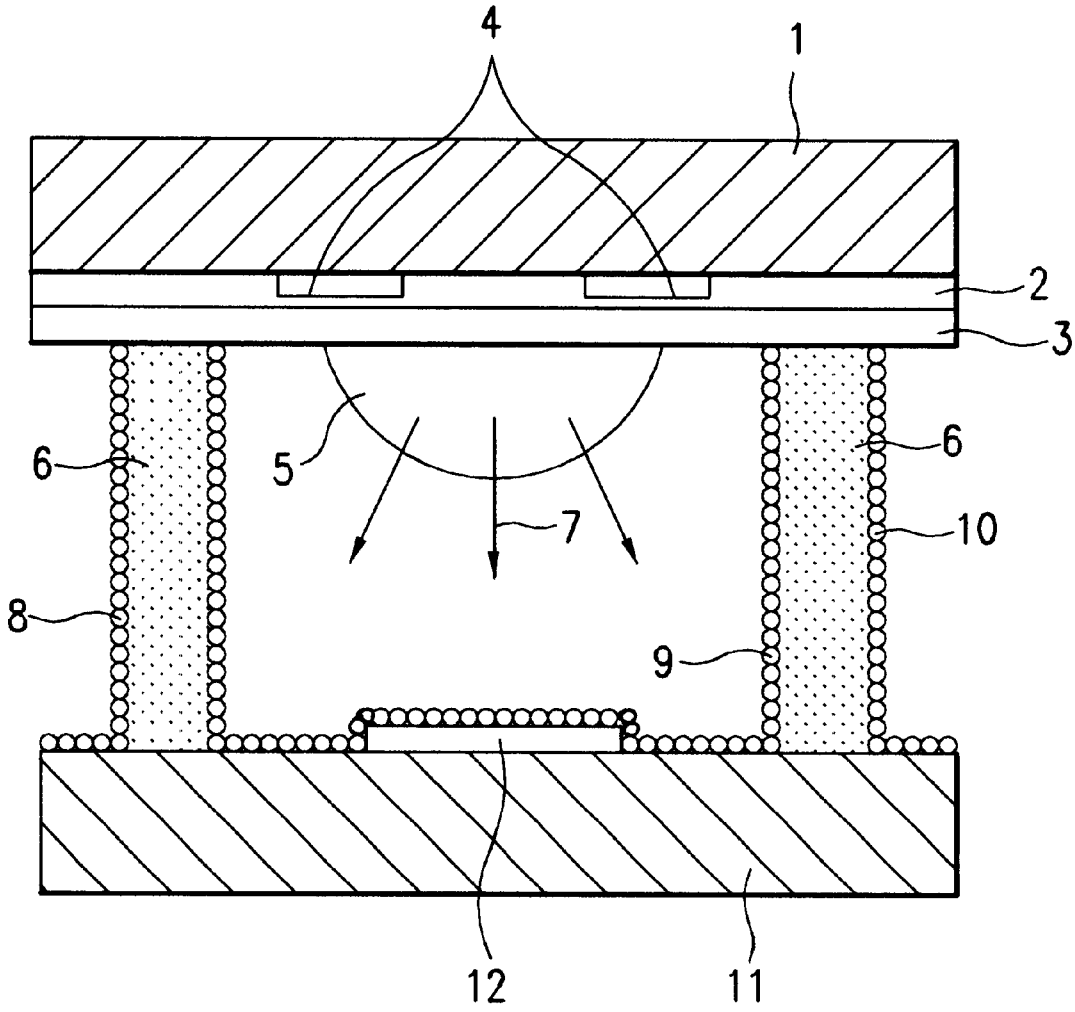
FIG.1 Related Art
FIG. 1 shows a sectional structure of a related art AC PDP of three-electrode area discharge.
Figure 2:
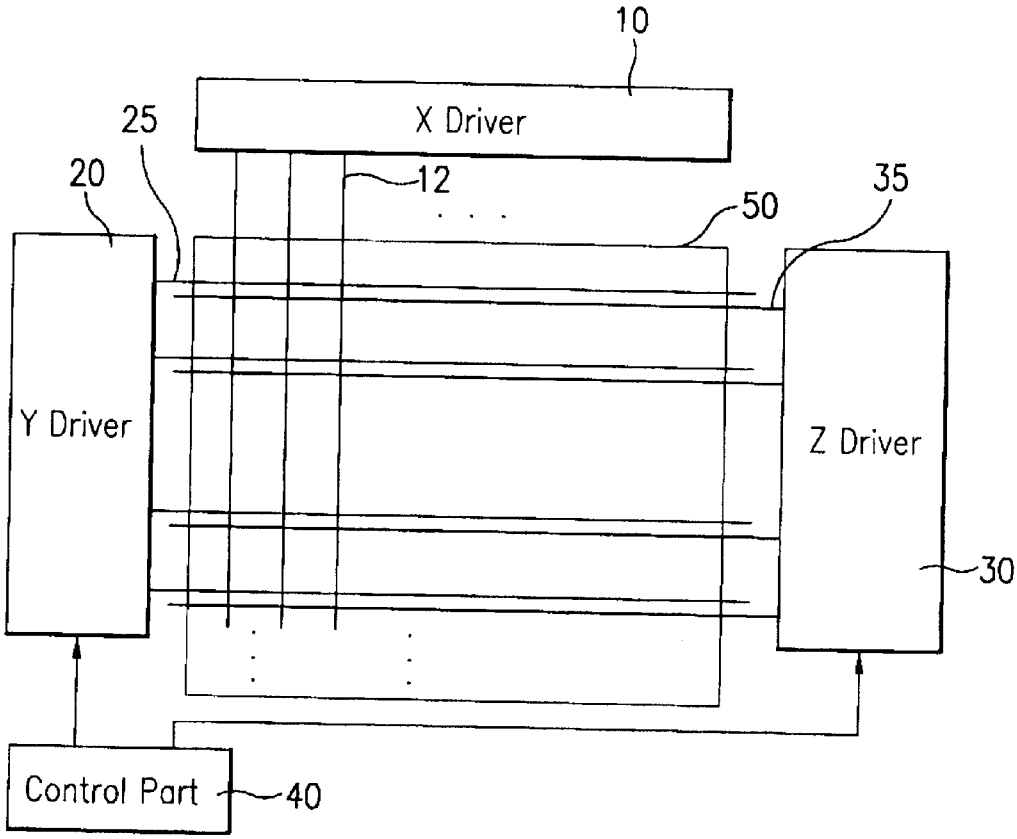
FIG.2 Related Art
FIG. 2 is a block diagram showing the PDP of FIG. 1 and a driving circuit.
Figure 3:
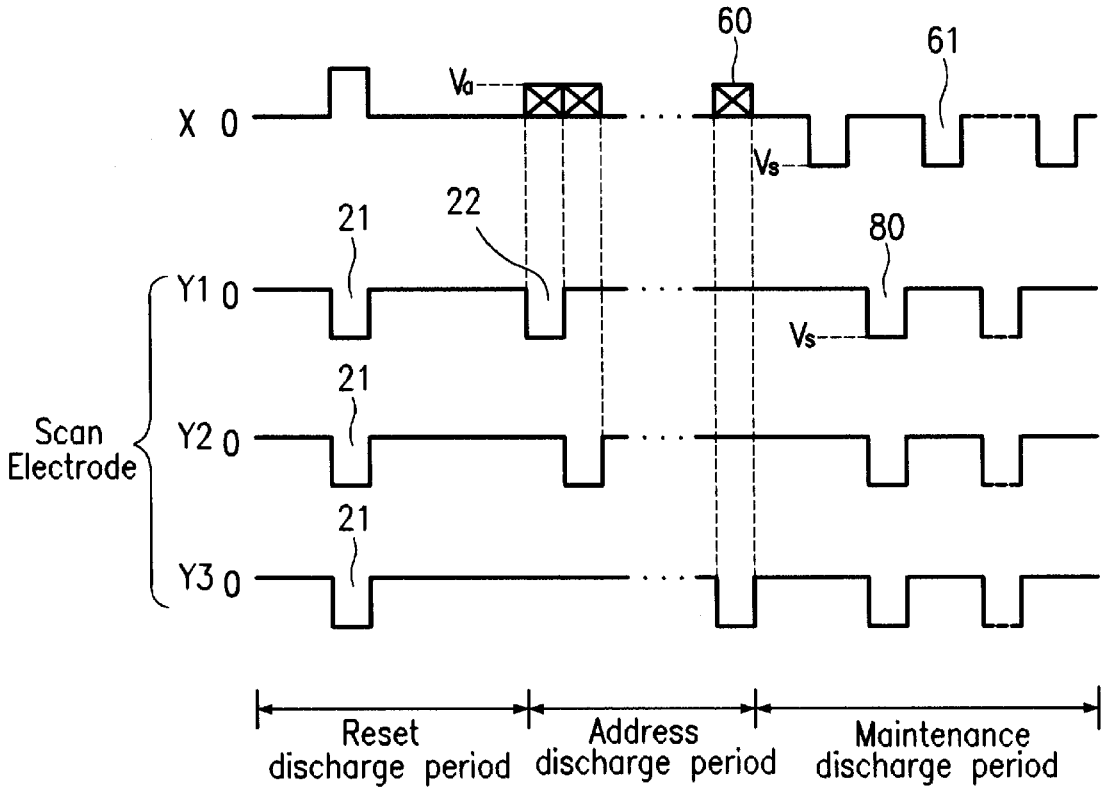
FIG.3 Related Art
FIG. 3 shows waveforms of pulses applied to each electrode of the PDP of FIGS. 1 and 2.
Figure 4:
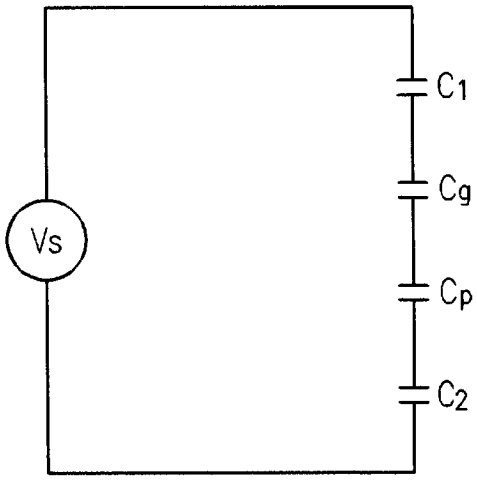
FIG.4 Related Art
FIG. 4 is a circuit diagram showing an equivalent circuit of each discharge cell of a PDP to which a discharge voltage is applied.
Figure 5A:
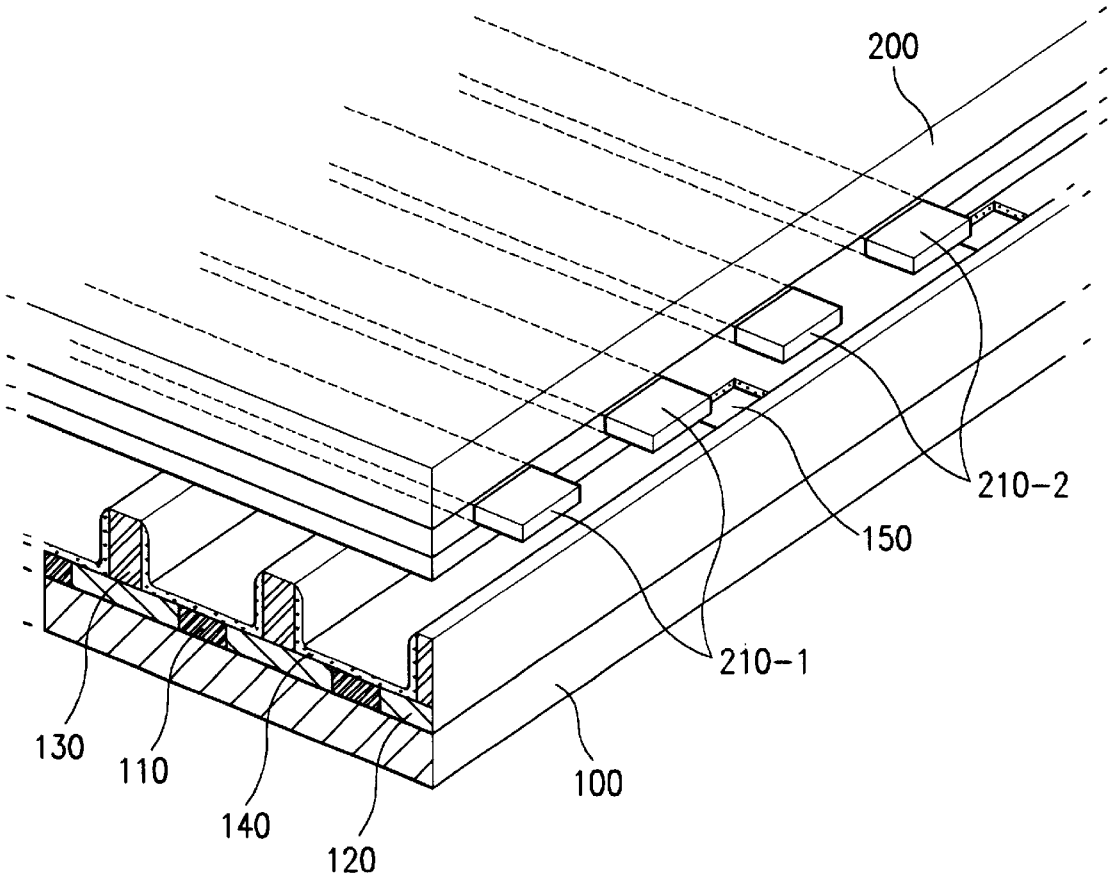
FIG. 5*a* shows a section of a PDP according to the present invention.

As shown in FIG. 5*a*, a PDP according to the present invention includes a plurality of lower electrodes 110 successively formed on a first substrate 100 in row direction, a plurality of isolation walls 130 formed between the lower electrodes 110, a plurality of upper electrode sets 210_1 210_2, . . . successively formed on a second substrate 200 opposite to the first substrate 100 to cross the lower electrodes 110, and a phosphor 140 formed on the first substrate 100 to expose some of the lower electrodes 110 crossed the upper electrode sets 210_1, 210_2, . . . .

The first substrate 100 is a transparent glass substrate, and a white reflecting thin film (not shown) may be formed on a rear surface of the first substrate 100.

In case of the upper electrode sets 210_1, 210_2, . . . , two upper electrodes may be formed as one set or a plurality of the upper electrodes more than two may be formed as one set.

A dielectric layer 120 may not be formed or may be deposited on an entire surface of the first substrate 100 in which the lower electrodes 110 are formed.

In case that the dielectric layer 120 is formed, the isolation walls 130 are formed on the dielectric layer 120 between the lower electrodes 110 to be in parallel with the lower electrodes 110. At this time, the isolation walls 130 isolate the dielectric layer 120 for areas by a predetermined width.

In case that the dielectric layer 120 is not formed, the isolation walls 130 are formed on the first substrate 100 between the lower electrodes 110.

The upper electrodes having the upper electrode sets 210_1, 210_2, . . . are formed on the second substrate 200 opposite to the first substrate 100 to cross the lower electrodes 110. At this time, the upper electrode sets 210_1, 210_2, . . . are successively formed to cross the lower electrodes 110.

Figure 5B:
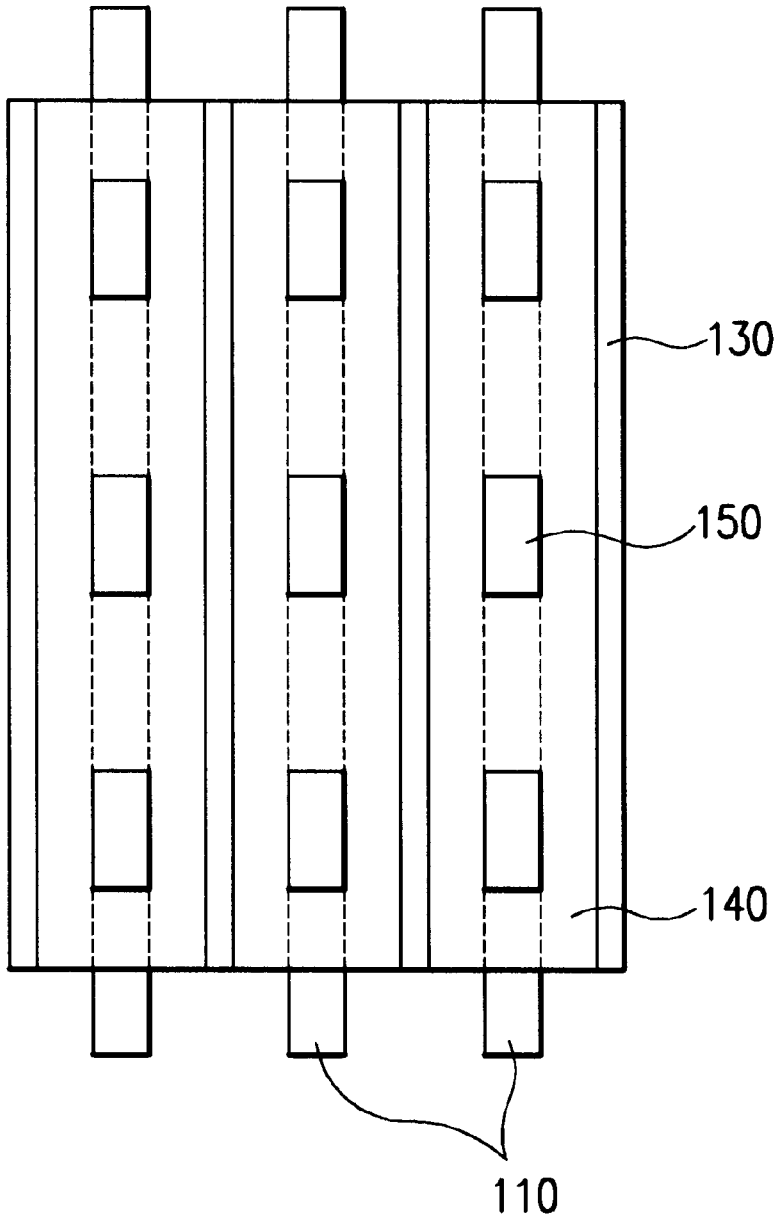
FIG. 5*b* shows a plane of a PDP according to the present invention.

As shown in FIG. 5*a*, the phosphor 140 is formed to expose the lower electrode between one upper electrode set 210_1 and its adjacent upper electrode set 210_2. That is to say, a groove 150 on which the phosphor is not formed is formed on some of the lower electrodes as shown in FIG. 5*b*. In other words, some of the lower electrodes 110 are exposed by the groove 150. Accordingly, some of the dielectric layer on the lower electrode formed in a crossing between a black matrix layer and the lower electrode is exposed by the groove on which the phosphor 140 is not deposited.

The groove 150 has a rectangular shape and the length of the groove 150 in short direction may be formed at the same as the length of the lower electrodes 110 in short direction. The groove is patterned to have a certain size.

The color PDP includes a red phosphor formed in some of a discharge area between the isolation walls, a blue phosphor formed in some of another discharge area adjacent to the discharge area of the red phosphor, and a green phosphor formed in some of other discharge area adjacent to the discharge area of the blue phosphor.

The operation of the PDP according to the present invention will be described in comparison with the related art PDP.

Figure 6A:
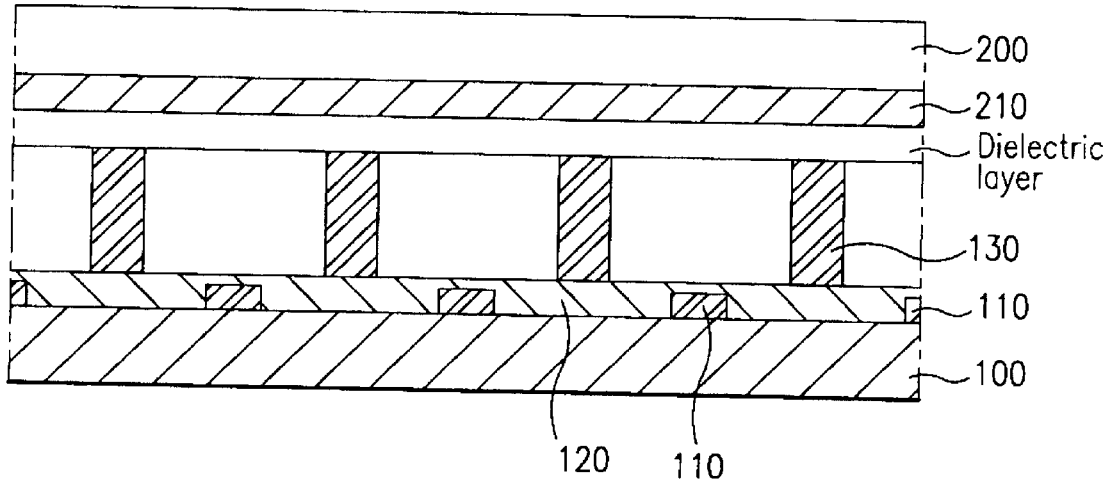
FIG.6A Related Art
FIG. 6*a* shows a discharge cell of a related art PDP in which a phosphor is not formed.
Figure 6B:
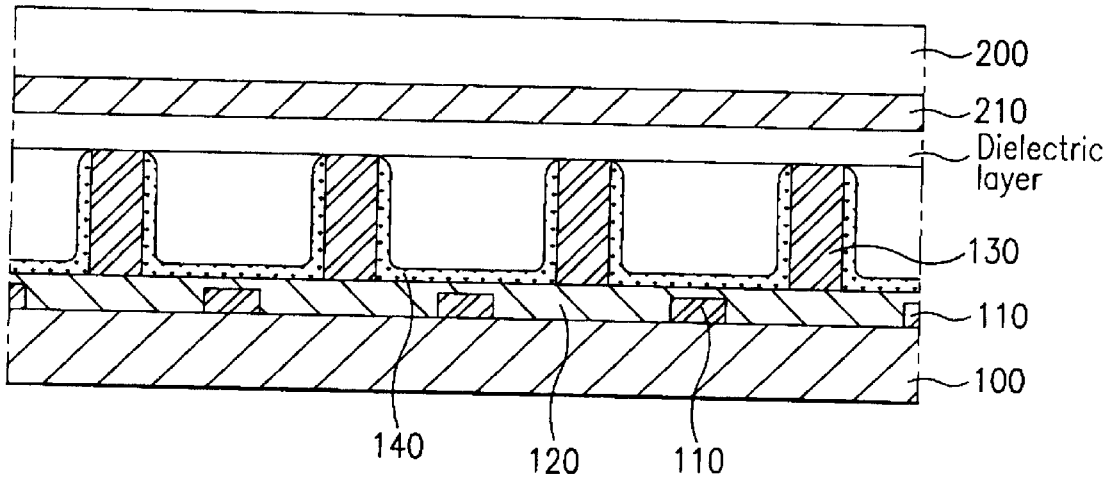
FIG.6B Related Art
FIG. 6*b* shows a discharge cell of a related art PDP in which a phosphor is deposited on an entire surface of a dielectric.
Figure 6C:
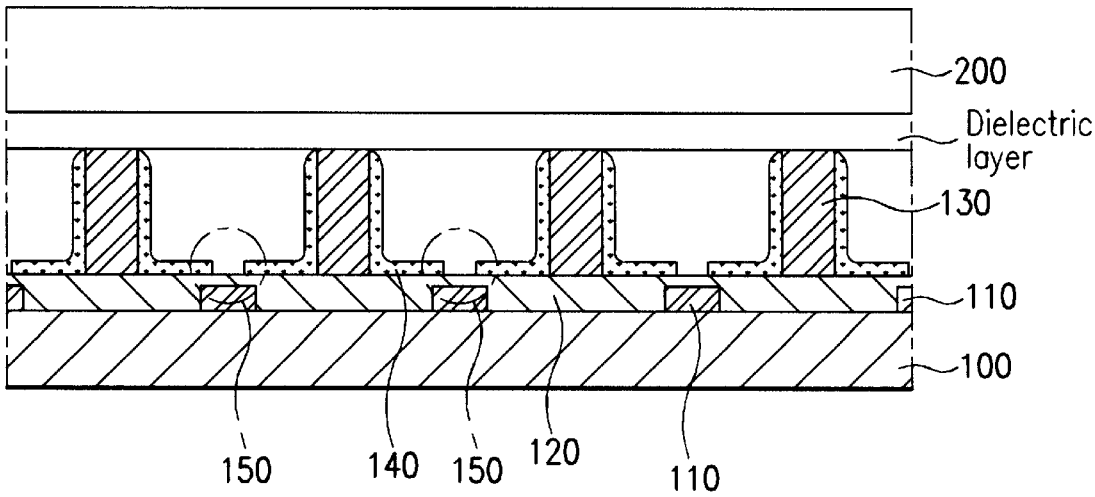
FIG. 6*c* shows a discharge cell of a PDP according to the present invention in which a phosphor is deposited on some of a dielectric.

FIG. 6*a* shows a discharge cell in which the phosphor is not formed, FIG. 6*b* shows a discharge cell of the related art PDP in which the phosphor 140 is formed to cover the whole lower electrodes 110, and FIG. 6*c* shows a discharge cell of the PDP according to the present invention in which the phosphor 140 on the lower electrodes 110 is partially removed to form the groove 150.

Since the discharge cell on which the phosphor is not deposited does not have capacitance of the phosphor, voltage drop due to the phosphor does not occur.

Figure 7A:
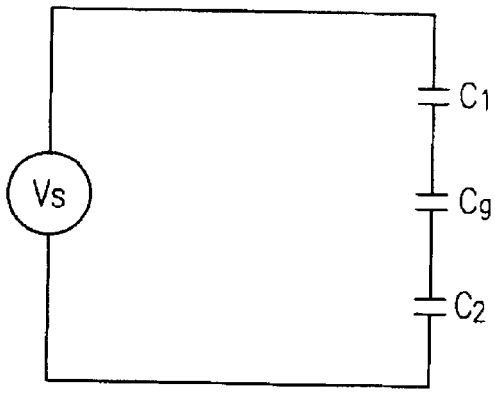
FIG.7A Related Art
FIG. 7*a* is a circuit diagram showing an equivalent circuit of the discharge cell shown in FIG. 6*a*.
Figure 7B:
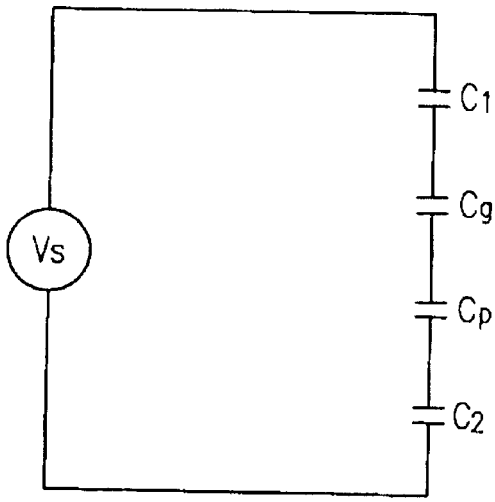
FIG.7B Related Art
FIG. 7*b* is a circuit diagram showing an equivalent circuit of the discharge cell shown in FIG. 6*b*.

In other words, the equivalent circuit of the discharge cell of FIG. 6*a* is the same as that of FIG. 7*a*. The voltage Vs shown in FIGS. 7*a* and 7*b* is an externally applied voltage to the discharge cell, $C_1$ is a capacitance of the upper substrate in the cell to be discharged, Cg is a capacitance of the discharge space, Cp is a capacitance of the phosphor to be emitted, and $C_2$ is a capacitance of the lower substrate in the cell to be discharged excluding Cp.

In the discharge cell of the related art PDP in which the phosphor 140 is formed to cover the whole lower electrodes 110, drop of the discharge voltage applied to the discharge area between the upper electrode and the lower electrode occurs due to capacitance Cp included in the phosphor 140. At this time, capacitance Cp of the phosphor is determined by the dielectric constant of the phosphor and its thickness. Accordingly, if the phosphor is deposited on the whole discharge cells at the same thickness, the capacitance of the respective discharge cells is varied by the dielectric constants of the respective phosphors of red, blue and green. After all, it is noted that the discharge voltage applied to the discharge areas of the respective discharge cells depends on the capacitance of the respective phosphors. For this reason, the discharge time and emitting luminance are varied even through the same discharge voltage is applied to the respective discharge cells. Particularly, the discharge cell on which the green phosphor is deposited has the latest discharge time and the lowest luminance because the green phosphor has the highest dielectric constant so that the green phosphor has the largest capacitance.

However, in the discharge cell of the PDP according to the present invention, since the phosphor on the lower electrode is partially removed to form the groove 150, the capacitance Cp of the phosphor 140 can be minimized. Accordingly, the discharge voltage is less susceptible to the phosphor. The reason why is that the phosphor is little formed din an area where the opposite discharge occurs. That is, the phosphor is mainly formed in an area where the opposite discharge does not occur. The equivalent circuit of the discharge cell in FIG. 6*c* is the same as that of FIG. 7*b* but its capacitance Cp included in the phosphor has a smaller value than those of other factors unlike the discharge cell in FIG. 6*a*. The discharge voltage almost similar to the discharge voltage from the equivalent circuit of FIG. 7*a* is applied to the discharge area of the discharge cell in FIG. 6*c* regardless of the kinds of the phosphors. Thus, the respective discharge cells have the almost same discharge time and luminance.

The color PDP according to the present invention has the following advantages.

The respective discharge cells on which different phosphors are deposited have the same discharge time and emitting luminance. In other words, since the discharge voltages applied to the discharge areas of the while discharge cells are maintained at the almost same level, the respective discharge cells are simultaneously discharged when the same driving voltage is applied to the respective discharge cells, thereby generating the same emitting luminance. Moreover, since the phosphor is little formed in the area where the opposite discharge of the respective discharge cell occurs, degradation of the phosphor little occurs, thereby improving picture quality and increasing life-span.

It will be apparent to those skilled in the art that various modifications and variations can be made in the PDP according to the present invention without departing from the spirit or scope of the invention. Thus, it is intended that the present invention covers the modifications and variations of the invention provided they come within the scope of the appended claims and their equivalents.

What is claimed is:

1. A PDP, comprising:

a plurality of lower electrodes successively formed on a first substrate and extending in a first direction;

a plurality of isolation walls formed between the lower electrodes;

a plurality of upper electrode sets comprising more than one upper electrode successively formed on a second substrate opposite to the first substrate, wherein the upper electrodes sets extend in a second direction that crosses the first direction; and a phosphor formed continuously on the first substrate to cover portions of the isolation walls, and at least one of the lower electrodes, wherein grooves are formed in the phosphor over portions of the lower electrodes located between the upper electrode sets.

2. The PDP as claimed in claim 1, wherein the grooves are formed in the phosphor only over portions of the lower electrodes located between adjacent upper electrode sets.

3. The PDP as claimed in claim 1, further comprising a dielectric layer formed between the phosphor and the first substrate.

4. A PDP comprising:

A first substrate having a plurality of lower electrodes that extend in a first direction;

a second substrate having a plurality of pairs of upper electrodes that extend in a second direction that crosses the first direction;

a dielectric layer formed on the first substrate between the lower electrodes;

isolation walls formed on the dielectric layer between the lower electrodes; and a phosphor formed at sides of the isolation walls continuously along the length of the lower electrodes and on the dielectric layer, and wherein grooves are formed in the phosphor only under one of the two upper electrodes in each electrode pair.

5. The PDP as claimed in claim 4, wherein the grooves in the phosphor are rectangular grooves.

6. The PDP as claimed in claim 5, wherein the rectangular grooves have the same width in their short direction as that of each of the lower electrodes.

7. A PDP, comprising:

a first substrate and a second substrate opposite to the first substrate;

a plurality of lower electrodes formed on the first substrate and extending in a first direction at a predetermined interval;

a dielectric layer formed on the first substrate between the lower electrodes;

isolation walls formed on the dielectric layer between the lower electrodes and extending in same direction as the lower electrodes;

a plurality of upper electrode sets formed on the second substrate at a predetermined interval, wherein the upper electrode sets extend in a second direction that crosses the lower electrodes; and a plurality of different phosphors formed at sides of the isolation walls and over the dielectric layer and the lower electrodes, wherein grooves are formed in only one of the phosphors to lower a capacitance of that phosphor.

8. The PDP as claimed in claim 7, wherein the upper electrode sets comprise pairs of upper electrodes, and wherein the grooves are formed in the phosphor where the lower electrodes oppose only one electrode of each upper electrode set.

9. The PDP as claimed in claim 7, wherein the grooves are only formed in an area between the adjacent upper electrode sets.

10. The PDP as claimed in claim 7, wherein the grooves are formed such that the grooves have a width the is the same size as a width of the lower electrodes.

11. The PDP as claimed in claim 7, wherein the grooves have rectangular shapes.

12. The PDP as claimed in claim 11, wherein the grooves have rectangular shapes with the same width in their short direction as that of the lower electrodes.

13. The PDP as claimed in claim 7, further comprising a black mask layer formed on the second substrate between the upper electrode sets and opposite to the exposed portions of the dielectric layer.

14. The PDP as claimed in claim 7, wherein each upper electrode set comprises at least two electrodes, and wherein the grooves are formed in the area which opposes only one electrode of each upper electrode set.

15. The PDP as claimed in claim 7, wherein the plurality of phosphors comprise at least three different phosphors, each of which is configured to emit a different color light, and wherein the grooves are formed in only one of the phosphors such that the capacitance of discharge areas of all of the phosphors are approximately equal.

16. The PDP as claimed in claim 7, wherein the plurality of phosphors comprise a red phosphor, a green phosphor and a blue phosphor.

17. The PDP as claimed in claim 16, wherein the grooves are formed in the green phosphor, and wherein the grooves in the green phosphor cause the discharge areas with the green phosphor to have about the same capacitance as the discharge areas with the red and blue phosphors.

18. The PDP as claimed in claim 16, wherein the grooves are only formed in the green phosphor.

19. A PDP, comprising:

a first substrate;

a plurality of elongated first electrodes formed on the first substrate and extending in a first direction;

a second substrate positioned over the first substrate;

a plurality of elongated second electrodes formed on the second substrate and extending in a second direction, wherein the second direction crosses the first direction;

a first phosphor formed over a first set of the first electrodes, wherein the first phosphor is configured to emit a first color light; and a second phosphor formed over a second set of the first electrodes, wherein the second phosphor is configured to emit a second color light, and wherein selected portions of the second phosphor have been removed to lower a capacitance of emission zones of the PDP that utilize that second phosphor.

20. The PDP of claim 19, wherein the second phosphor is configured to output green light.

21. The PDP of claim 19, wherein the capacitance of emission zones of the PDP that utilize the second phosphor are approximately equal to a capacitance of emission zones of the PDP that utilize that first phosphor.

22. The PDP of claim 19, further comprising a third phosphor formed over a third set of the first electrodes, wherein the third phosphor is configured to emit a third color light, and wherein the capacitance of emission zones of the PDP that utilize the second phosphor are approximately equal to a capacitance of emission zones of the PDP that utilize the first and third phosphors.

23. The PDP of claim 19, wherein the selected portions of the second phosphor that have been removed are located between the plurality of elongated second electrodes.

24. The PDP of claim 19, wherein each of the plurality of elongated second electrodes comprises:

a scan electrode; and a sustain electrode.

25. The PDP of claim 24, wherein the selected portions of the second phosphor that have been removed are located opposite the scan electrode.

26. The PDP of claim 24, wherein the selected portions of the second phosphor that have been removed are located opposite the sustain electrodes.

* * * * *